US005096755A

United States Patent [19]

Nakagawa et al.

[11] Patent Number: 5,096,755

[45] Date of Patent: Mar. 17, 1992

[54] PACKAGING MEDIUM FOR ELECTROPHOTOGRAPHIC PHOTOSENSITIVE MEMBER

[75] Inventors: Masaru Nakagawa, Yokohama; Masaaki Hiro, Kanagawa; Yoichi Kawamorita, Yokohama, all of Japan

[73] Assignee: Canon Kabushiki Kaisha, Tokyo, Japan

[21] Appl. No.: 354,034

[22] Filed: May 19, 1989

[30] Foreign Application Priority Data

May 20, 1988 [JP] Japan ..... 63-121941

[51] Int. Cl.[5] ..... H01B 1/06; B65D 30/02

[52] U.S. Cl. ..... 428/35.5; 252/511; 524/495

[58] Field of Search ..... 428/35.5, 34.5, 35.2, 428/408; 524/495; 252/511

[56] References Cited

U.S. PATENT DOCUMENTS

| | | | |
|---|---|---|---|
| 4,337,285 | 6/1982 | Akao et al. | 428/35.3 |
| 4,551,367 | 11/1985 | Nagatani et al. | 206/328 |
| 4,569,786 | 2/1986 | Deguchi | 524/495 |
| 4,585,578 | 4/1986 | Yonahara et al. | 524/495 |
| 4,655,964 | 4/1987 | Steinberger et al. | 524/495 |
| 4,699,830 | 10/1987 | White | 428/35.3 |
| 4,738,882 | 4/1988 | Rayford et al. | 428/35.3 |
| 4,780,357 | 10/1988 | Akao | 428/35.3 |
| 4,795,592 | 1/1989 | Lander et al. | 524/495 |
| 4,876,129 | 10/1989 | Akao | 428/35.3 |
| 4,976,890 | 12/1990 | Felter et al. | 252/511 |

FOREIGN PATENT DOCUMENTS

| | | |
|---|---|---|
| 58-116565 | 7/1983 | Japan . |
| 2196601A | 5/1988 | United Kingdom . |

*Primary Examiner*—James J. Seidleck

*Attorney, Agent, or Firm*—Fitzpatrick, Cella, Harper & Scinto

[57] ABSTRACT

A packaging medium for an electrophotographic photosensitive member contains a conductive material and has a volume resistivity of not more than $10^{12}$ Ω.cm.

12 Claims, 2 Drawing Sheets

PACKAGING MEDIUM FOR ELECTROPHOTOGRAPHIC PHOTOSENSITIVE MEMBER

BACKGROUND OF THE INVENTION

1. Field of the Invention

The present invention relates to a protective member for an electrophotographic photosensitive member, and more particularly to a packaging medium for use in an electrophotographic photosensitive member, that can provide electrophotographic photosensitive members free of any defective copy.

2. Related Background Art

Inorganic photoconductors such as cadmium sulfide, selenium and zinc oxide have been hitherto used in electrophotographic photosensitive members, but, in recent years, organic photoconductors (hereinafter "OPC"), amorphous silicon or the like also have come to be used.

In particular, in instances in which these photosensitive members are used in an electrophotographic apparatus of a Carlson type, dents or scratches produced on the surface of a photosensitive member, and stains of fingerprints or oil are known to adversely affect images, and a variety of forms of packaging photosensitive members are devised to solve such problems.

For example, in the instance of photosensitive members comprising selenium or amorphous silicon, they are kept in a casing so designed that nothing may come into contact with the surface of the photosensitive member, and moreover the operation to change photosensitive members for new ones is carried out by specialized operator (servicemen), requiring very complicated handling.

In the OPC photosensitive members, gaining a remarkable progress in production in proportion to the rapid spread of electrophotographic apparatus in recent years. What is also required is a simple photosensitive member packaging form that is very easy and makes it possible for users of general electrophotographic apparatus to readily change photosensitive members. As one of the countermeasures therefor, there have been proposed and put into practical use a method in which the surface of a photosensitive member is covered with a peelable thin film member, whereby the thin film member is peeled after the photosensitive member has been set in the electrophotographic apparatus.

However, the above easy and simple packaging method in which the photosensitive member is covered with the peelable thin film member has a fundamental disadvantage, i.e., the problem that triboelectrification is caused between the packaging member and the photosensitive member, resulting in accumulation of electrostatic charges on the surface of the photosensitive member.

The accumulated electrostatic charges remain on the surface of the photosensitive member, to cause image uneveness or defective copy, i.e., so-called charging memory, when images are produced using the electrophotographic apparatus.

SUMMARY OF THE INVENTION

Accordingly, an object of the present invention is to provide a packaging medium for an electrophotographic photosensitive member, that can eliminate the cause of so-called charging memory.

As a result of intensive studies made along the above object, the present inventors have found that a conductive material may be contained in the thin film member that constitutes the packaging medium for a photosensitive member, and thereby the charging memory does not occur.

More specifically, the present invention provides a packaging medium for an electrophotographic photosensitive member, comprising a conductive material, contained as a component of the packaging medium for an electrophotographic photosensitive member, said packaging medium being made to have a volume resistivity of not more than $10^{12}$ Ω.cm.

DESCRIPTION OF THE PREFERRED EMBODIMENTS

Figure 1:
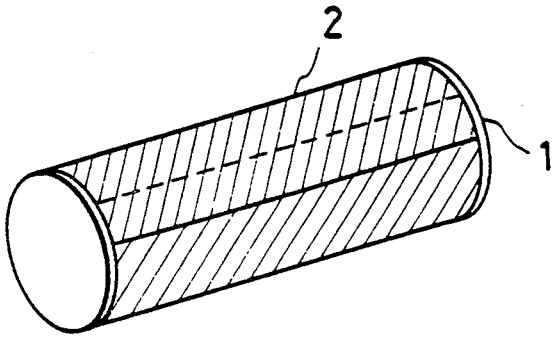
FIGS. 1 and 2 diagramatically illustrate examples of the forms of the packaging medium for an electrophotographic photosensitive member.

The mechanism by which the charging memory is caused is not clearly detailed, but is presumably explained as follows:

The electrophotographic photosensitive member has charging polarities of two opposite charges, one positive and one negative. Charging potential is given on the surface of the photosensitive member as a result of corona discharge, depending on the characteristics of the photosensitive member.

For example, the most commonly available OPC photosensitive member having a charge transport layer on its surface has the negative charging polarity, giving negative charge potential thereon, and the negative charge given on the surface is cancelled or gradually attenuated because of carriers (positive holes) generated in a charge generation layer or injected from a substrate.

On the other hand, once the positive charging potential is given to the photosensitive member having this negative charging polarity, it follows that positive charge always remains on the surface layer because the electrons that act to cancel the positive charge can not migrate in the charge transport layer.

Hence, when images are produced by giving the negative charging potential with use of the photosensitive member having the negative charging polarity, to the surface of which the positive charge is imparted as a result of triboelectrification or the like, the surface potential shared by the positive charge is lowered to cause partial image uneveness such as blank areas, or defective copy, i.e., so-called charging memory.

In a positively chargeable OPC photosensitive member having the charge generation layer on its surface, it also occurs that the negative charge, the opposite charge, always remains once imparted to the surface, resulting in the charging memory generated like the above.

In general, in the OPC photosensitive members, a charge-transporting material and a charge-generating material, which are comprised of low-molecular compounds, have poor film forming properties, so that resins are used as binders.

The triboelectrification polarity of the photosensitive member therefore depends on the correlation between the resins used as binders and the packaging medium. Namely, the negative charge is imparted to the surface of the photosensitive member when a packaging medium having a stronger electron donative property than the binder resin on the surface of the photosensitive member is used. On the other hand, the positive charge is imparted to the photosensitive member when a packaging medium having a stronger electron attractive property than the binder resin is used.

However, no electrostatic charging may result when in general a material has a volume resistivity of not more than $10^{12}$ Ω.cm.

Accordingly, a conductive material may be contained in the packaging medium to control the volume resistivity to be not more than $10^{12}$ Ω.cm, thereby achieving the effect of preventing the triboelectrification on the photosensitive member.

In particular, a packaging medium having a volume resistivity of not more than $10^5$ Ω.cm can exhibit a greater effect of preventing the triboelectrification on the photosensitive member and suppressing occurrence of the charging memory.

The packaging medium of the present invention may preferably have a form in which the conductive material is dispersed or dissolved in a resin. This form, in which the surface is formed of a resin, to cause no scratches on the surface of the photosensitive layer when the photosensitive member is packaged.

The conductive material that can be used in the present invention includes, for example, conductive metal oxides such as $SnO_2$, $InO_2$, $SbO_2$, etc. and conductive metal powders of Al, Cu, etc., or conductive carbon.

A conductive polymer of the type in which a quaternary ammonium salt is contained in its main chain or side chain may also be used as the conductive material.

Of these, particularly preferred is conductive carbon.

The conductive material may have a volume resistivity ranging preferably from $10^{-5}$ to $10^{11}$ Ω.cm, and particularly from $10^{-4}$ to $10^{-1}$ Ω.cm.

The conductive material may preferably be contained in an amount ranging from 5 to 70 wt. %, and particularly from 10 to 50 wt. %.

The resin in which the conductive material is contained includes, for example, polystyrene, nylon resins, polyester and polyethylene, and particularly preferably polystyrene, nylon resins and polyester.

The packaging medium may be formed in various types including, for example, a single layer structure type in which the conductive material is contained, a laminated structure type in which a layer containing the conductive material is provided on a metal sheet or resin sheet by coating or adhesion, and a deposition type in which a metal is vapor deposited on a layer containing the conductive material.

The packaging medium may preferably have a film thickness ranging from 50 to 500 μm, and particularly from 70 to 300 μm.

In the packaging medium of the present invention, a colorant such as carbon or a coloring pigment may be mixed in the packaging medium or the surface thereof may be colored, or a layer containing the conductive material may be provided on a resin sheet in which the colorant is mixed or the surface of which is colored, thereby imparting a light-screening, or light-intercepting function. In particular, the light-screening function may preferably be imparted to the OPC photosensitive members from the viewpoint of a countermeasure to photomemory, preferably with a light-screening rate of not less than 90% (or a light-transmittance of not more than 10%).

Figure 2:
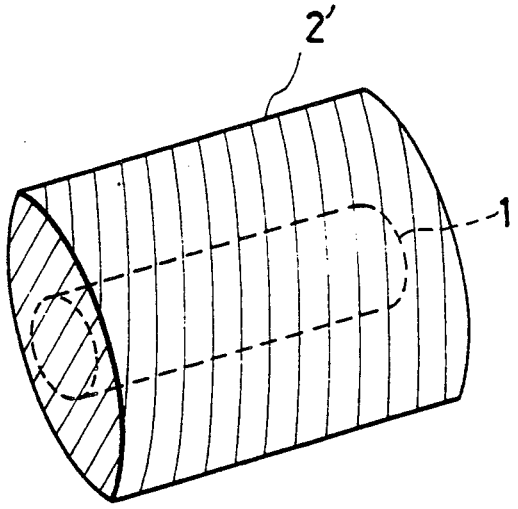

The packaging medium of the present invention may be embodied in the form of a film 2 (FIG. 1), which is wrapped around a photosensitive member 1; in the form of a bag 2' (FIG. 2), into which the photosensitive member 1 is put; or in the form of a plate free from bending, between which a sheet-like photosensitive member is held.

Figure 3A:
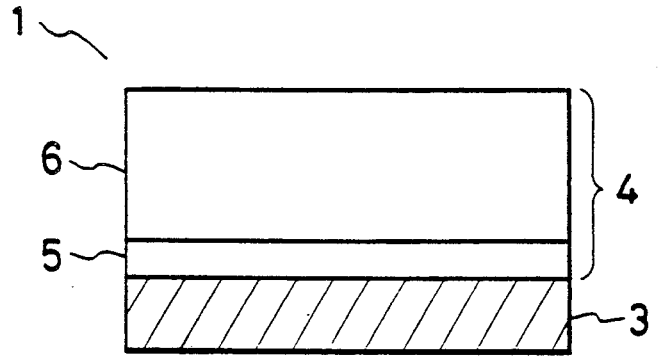
FIGS. 3A and 3B diagramatically illustrate layer constitutions of the electrophotographic photosensitive member.
Figure 3B:
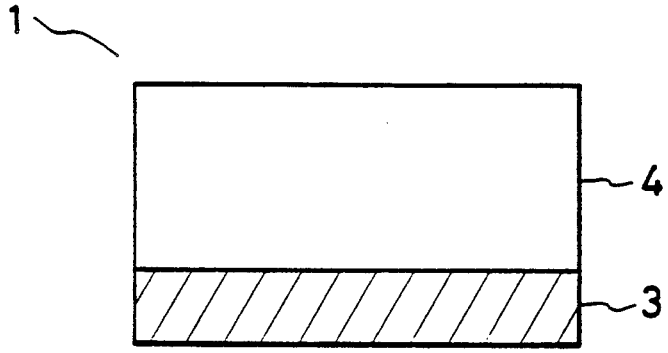

The electrophotographic photosensitive member fundamentally comprises, as illustrated in FIGS. 3A and 3B, a conductive substrate 3 and a photosensitive layer 4 provided thereon.

The photosensitive layer 4 includes a laminated structure type (FIG. 3A) comprising a charge generation layer 5 containing a charge-generating material and a charge transport layer 6 containing a charge-transporting material, and a single layer structure type (FIG. 3B) containing the charge-generating material and charge-transporting material in the same layer.

The charge-generating material includes organic photoconductors such as azo pigments, phthalocyanine pigments and anthanthrone pigments, and inorganic photoconductors such as selenium and amorphous silicon.

The charge-transporting material includes organic photoconductors such as hydrazone compounds, stilbene compound, carbazole compounds and triarylamine compounds.

The charge generation layer can be formed, for example, by vapor depositing the above charge-generating material or coating it, optionally together with a binder resin having a film forming property. The charge generation layer may preferably have a film thickness ranging from 0.01 to 3 μm, and particularly from 0.05 to 1 μm.

The charge transport layer can be formed, for example, by coating the above charge-transporting material together with a binder resin having a film forming property. The charge transport layer may preferably have a film thickness ranging from 10 to 30 μm, and particularly from 15 to 25 μm.

In the instance where the photosensitive layer is of the single layer type, the photosensitive layer can be formed, for example, by coating the above charge-generating material and charge-transporting material together with a binder resin having a film forming property. In this instance, the layer may preferably have a film thickness ranging from 10 to 50 μm, and particularly from 15 to 40 μm.

The binder resin includes polycarbonate resins, polystyrene resins, polymethyl methacrylate resins, polyester resins, and polyarylate resins.

As the conductive substrate, there can be used metals such as aluminum, aluminum alloy and stainless steel, and metals or plastics provided with a conductive layer containing conductive particles. The conductive substrate may have the shape of a cylinder, a sheet, or the like.

A subbing layer may also be provided between the conductive substrate 3 and photosensitive layer 4 to improve barrier properties or improve adhesion.

EXAMPLE

The present invention will be described below in greater detail by giving Examples and Comparative Examples. In the following, "part(s)" is by weight.

EXAMPLE 1

An aluminum cylinder of 80 mm $\phi \times 360$ mm used as the conductive substrate was dip coated with a methanol solution of 5% of a soluble nylon (a 6-66-610-12 four-nylon copolymer), to provide thereon a subbing layer with a thickness of 1 $\mu$m.

Next, 10 parts of a disazo pigment represented by the following structural formula:

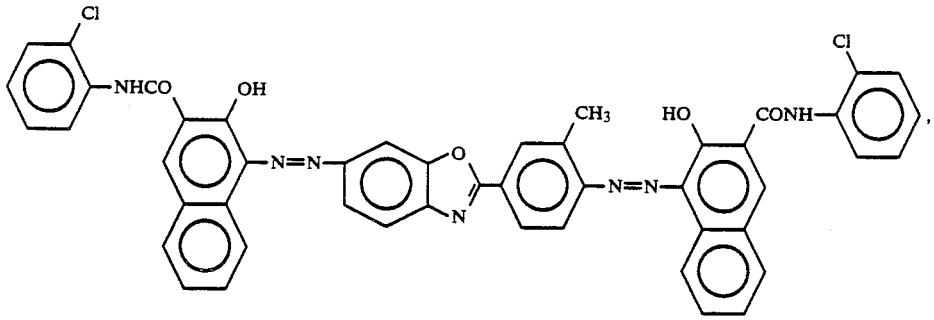

5 parts of polyvinyl butyral (degree of butyralization: 68%; average molecular weight: 20,000) and 50 parts of cyclohexanone were dispersed for 20 hours with a sand mill in which glass beads of one (1) mm $\phi$ were used. In the resulting dispersion, 70 to 120 parts (appropriately selected) of methyl ethyl ketone was added, and the resulting solution was applied on the subbing layer, to form a charge generation layer with a film thickness of 0.1 $\mu$m.

Next, 10 parts of bisphenol Z polycarbonate (viscosity average molecular weight: 30,000) and 10 parts of a hydrazone compound represented by the following structural formula:

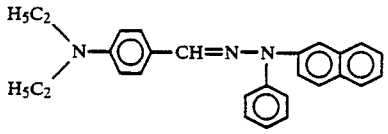

were dissolved in 65 parts of monochlorobenzene, and the resulting solution was applied on the above charge generation layer by dip coating to form a charge transport layer with a thickness of 18 $\mu$m.

The electrophotographic photosensitive member thus prepared is designated as a photosensitive member sample A.

Another electrophotographic photosensitive member was prepared in entirely the same manner as the above, except that bisphenol A polycarbonate (viscosity average molecular weight: 28,000) was used in place of the bisphenol Z polycarbonate, and this is designated as a photosensitive member sample B.

A sheet-like electrophotographic photosensitive member was also prepared by replacing the above aluminum cylinder with an aluminum sheet of 50 $\mu$m thick, on which the above subbing layer solution, the charge generation layer solution and the charge transport layer solution in which bisphenol Z polycarbonate was used were applied using a bar coater to give the same film thickness as the above. This is designated as a photosensitive member sample C.

Next, a packaging medium was prepared in the following manner.

Into a Banbury mixer, 60 parts of polystyrene (average molecular weight: 20,000) as a binder resin, 20 parts of carbon powder (average particle diameter: 0.05 $\mu$m) as a colorant and 20 parts of $SnO_2$ powder (average particle diameter: 0.5 $\mu$m) as a conductive powder were put, and these were mixed with heating at 180° C.

Thereafter, the mixture was formed into a film of 360 mm in length, 360 mm in width and 100 $\mu$m in film thickness by a calendering film formation process, to prepare a packaging medium. This film had a volume resistivity of $10^{10}$ $\Omega$.cm, and showed a light-screening property with a screening rate of 99%. This is designated as a packaging medium sample 1.

Next, another film-like packaging medium was prepared by using 70 parts of the like polystyrene as the above and 30 parts of the like conductive carbon powder as the above, which were mixed with heating at 180° C. using a Banbury mixer, followed by the same procedures as the packaging medium sample 1. The resulting film had a volume resistivity of $10^9$ $\Omega$.cm, and showed a light-screening property with a screening rate of 99%. This is designated as a packaging medium sample 2.

Also dispersed were 6 parts of the same polystyrene as the above, 10 parts of the like conductive carbon and 100 parts of cyclohexanone, for 5 hours using a sand mill in which glass beads of 1 mm $\phi$ were used. The resulting dispersion was applied on a polyethylene plate with a thickness of 10 $\mu$m by bar coating to carry out film formation, followed by drying at 100° C. for 30 minutes to form a film with a thickness of 10 $\mu$m. The resulting film had a volume resistivity of $10^4$ $\Omega$.cm and showed a light-screening property with a screening rate of 90%. This is designated as a packaging medium sample 3.

These packaging mediums were wrapped around the photosensitive members previously prepared.

In the case when the packaging medium is in the form of a plate, the sheet-like photosensitive member was inserted between plates.

Thereafter the packaging mediums were peeled, or taken off, from the photosensitive members, and the resulting photosensitive members were each set in a copying machine having electrophotographic processes comprising $-5.5$ kV corona charging, imagewise exposing to light, dry-toner developing, transferring to plain paper, and cleaning, to make evaluation on image production. Results obtained are shown later.

COMPARATIVE EXAMPLE 1

Packaging mediums made of polystyrene or polyethylene were respectively wrapped around, or put around, the photosensitive member samples A and C prepared in Example 1, and thereafter the packaging mediums were peeled, or taken off, to make evaluation on image production by use of the same electrophotographic copying machine as Example 1. Results obtained are shown below.

EXAMPLE 1

| Test No. | Photosensitive member sample | Packaging medium sample | Image evaluation results |
|---|---|---|---|
| 1 | A | 1 | Good |
| 2 | A | 2 | Good |
| 3 | B | 1 | Good |
| 4 | B | 2 | Good |
| 5 | C | 3 | Good |

COMPARATIVE EXAMPLE 1

| Test No. | Photosensitive member sample | Packaging medium sample | Image evaluation results |
|---|---|---|---|
| 6 | A | Polystyrene sheet | Blank areas appeared |
| 7 | C | Polyethylene plate | Blank areas appeared |

EXAMPLE 2

To prepare a packaging medium, 60 parts of polystyrene (average molecular weight: 20,000) as a binder resin, 20 parts of carbon powder (average particle diameter: 0.05 μm) as a colorant and 20 parts of conductive polymer having the following structure:

$$-(-CH_2-CH_2-N^+H-)_n-Cl^-$$

were formed into a film in the same manner as Example 1.

The resulting film had a volume resistivity of $10^9\Omega$.cm, and showed a light-screening property with a screening rate of 99%. This is designated as a packaging medium sample 4.

Another packaging medium was prepared in entirely the same manner as the above, except that the conductive polymer was replaced with the one having the following structure:

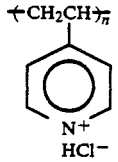

The resulting film had a volume resistivity of $10^9$ Ω.cm, and showed a light-screening property with a screening rate of 99%. This is designated as a packaging medium sample 5.

To prepare still another packaging medium, 10 parts of polystyrene and 10 parts of a conductive polymer having the following structure:

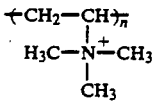

were dissolved in 100 parts of cyclohexanone.

The resulting solution was applied on a polyethylene plate with a thickness of 100 μm by bar coating to carry out film formation, followed by drying with heating to form a film with a thickness of 20 μm. The resulting film had a volume resistivity of $10^{10}$ Ω.Cm and showed a light-screening property with a screening rate of 95%. This is designated as a packaging medium sample 6.

Next, these packaging mediums were wrapped around, or put around, the photosensitive members prepared in Example 1, and thereafter the packaging mediums were peeled, or taken off, from the photosensitive members, and the resulting photosensitive members were each set in a copying machine having electrophotographic processes comprising −5.5 kV corona charging, imagewise exposing to light, dry-toner developing, transferring to plain paper, and cleaning, to make evaluation on image production. Results obtained are shown later.

COMPARATIVE EXAMPLE 2

Packaging mediums made of polystyrene or polypropylene were respectively wrapped around, or put around, the photosensitive member samples A and C prepared in Example 1, and thereafter the packaging mediums were peeled, or taken off, to make evaluation on image production by use of the same electrophotographic copying machine as Example 2. Results obtained are shown below.

EXAMPLE 2

| Test No. | Photosensitive member sample | Packaging medium sample | Image evaluation results |
|---|---|---|---|
| 8 | A | 4 | Good |
| 9 | B | 5 | Good |
| 10 | C | 6 | Good |

COMPARATIVE EXAMPLE 2

| Test No. | Photosensitive member sample | Packaging medium sample | Image evaluation results |
|---|---|---|---|
| 11 | A | Polystyrene sheet | Blank areas appeared |
| 12 | C | Polypropylene plate | Blank areas appeared |

EXAMPLE 3

In 65 parts of monochlorobenzene, 10 parts of the hydrazone compound as used in Example 1 and 10 parts of bisphenol Z polycarbonate were dissolved. The resulting solution was applied on an aluminum cylinder provided with a subbing layer by coating in the same manner as Example 1, to form a charge transport layer with a thickness of 12 μm.

Next, 10 parts of the disazo pigment as used in Example 1 was added in 100 parts of a cyclohexanone solution of 10 wt. % of bisphenol Z polycarbonate (viscosity average molecular weight: 53,000), and the mixture was dispersed for 20 hours using a sand mill in which glass beads of 1 mm ϕ were used. The resulting solution was applied on the above charge transport layer to form a charge generation layer with a thickness of 2 μm.

The electrophotographic photosensitive member thus prepared is designated as a photosensitive member sample D.

Packaging mediums were prepared in the same manner as Example 1 but using $SnO_2$ powder and conductive carbon respectively contained in nylon resins. These are designated as packaging medium samples 7 and 8, respectively. These had volume resistivities of $10^{10}$ Ω.cm and $10^9$ Ω.cm respectively, and showed light-screening property with screening rates of 99% and 99%, respectively.

Next, these packaging mediums were each wrapped around the photosensitive member sample D, and thereafter the packaging mediums were peeled from the photosensitive members, and the resulting photosensitive members were each set in a copying machine having electrophotographic processes comprising +5.5 kV corona charging, imagewise exposing to light, dry-toner developing, transferring to plain paper, and cleaning, to make evaluation on image production. Results obtained are shown later.

COMPARATIVE EXAMPLE 3

A packaging medium made of polymethyl methacrylate was wrapped around the photosensitive member sample D prepared in Example 3, and thereafter the packaging medium was peeled to make evaluation on image production by use of the same electrophotographic copying machine as Example 3. Results obtained are shown below.

EXAMPLE 3

| Test No. | Photosensitive member sample | Packaging medium sample | Image evaluation results |
|---|---|---|---|
| 13 | D | 7 | Good |
| 14 | D | 8 | Good |

COMPARATIVE EXAMPLE 3

| Test No. | Photosensitive member sample | Packaging medium sample | Image evaluation results |
|---|---|---|---|
| 15 | D | Polymethyl methacrylate | Blank areas appeared |

EXAMPLE 4

Example 1 was repeated to prepare photosensitive drums, except that polymethyl methacrylate (number average molecular weight: 45,000), a methyl methacrylate/styrene copolymer (weight ratio: 8/2; number average molecular weight: 62,000) and a methyl methacrylate/ethyl methacryalte copolymer (weight ratio: 6/4; number average molecular weight: 55,000) were respectively used in place of the polycarbonate used in Example 1. These are designated as photosensitive member samples E, F and G, respectively.

As packaging mediums, the packaging medium samples 1, 2 and 3 prepared in Example 1 were used, respectively, and the same evaluation on image production as Example 1 was made. Results obtained are shown later.

COMPARATIVE EXAMPLE 4

Using the photosensitive member samples E and F prepared in Example 4, and packaging mediums made of polystyrene or polyethylene, the same evaluation on image production as Example 4 was made. Results obtained are shown below.

EXAMPLE 4

| Test No. | Photosensitive member sample | Packaging medium sample | Image evaluation results |
|---|---|---|---|
| 16 | E | 1 | Good |
| 17 | F | 2 | Good |
| 18 | G | 3 | Good |
| 19 | E | 2 | Good |
| 20 | F | 3 | Good |
| 21 | G | 1 | Good |

COMPARATIVE EXAMPLE 4

| Test No. | Photosensitive member sample | Packaging medium sample | Image evaluation results |
|---|---|---|---|
| 22 | E | Polystyrene sheet | Blank areas appeared |
| 23 | F | Polyethylene sheet | Blank areas appeared |

EXAMPLE 5

Example 3 was repeated to prepare electrophotographic photosensitive members, except that the polymethyl methacrylate, methyl methacrylate/styrene copolymer and methyl methacrylate/ethyl methacrylate copolymer as used in Example 4 were respectively used in place of the polycarbonate used in Example 3. The respective photosensitive members are designated as photosensitive member samples H, I and J.

Packaging mediums were prepared in the same manner as Example 2 but using nylon resins in place of the polystyrene used in Example 2. The packaging mediums containing conductive polymers having the following structures are designated as packaging medium samples 7, 8 and 9, respectively. These had volume resistivities of $10^{10}$ Ω.cm, $10^9$ Ω.cm and $10^4$ Ω.cm, respectively, and showed light-screening properties with light-screening rates of 99%, 99% and 95%, respectively.

| Conductive polymer | Packaging medium sample |
|---|---|
| $\leftarrow CH_2-CH_2-\overset{+}{N}H\rightarrow_n Cl^-$ | 7 |
| 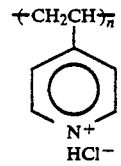 | 8 |
| $\leftarrow CH_2-CH\rightarrow_n$ <br> $H_3C-\overset{+}{N}-CH_n$ <br> $CH_3$ | 9 |

Using the photosensitive member samples H, I and J, and packaging medium samples 7, 8 and 9, the same evaluation on image production as Example 3 was made. Results obtained are shown later.

COMPARATIVE EXAMPLE 5

Using the photosensitive member samples H and J prepared in Example 5, and packaging mediums made of nylon, the same evaluation on image production as Example 5 was made. Results obtained are shown below.

EXAMPLE 5

| Test No. | Photosensitive member sample | Packaging medium sample | Image evaluation results |
|---|---|---|---|
| 24 | H | 7 | Good |
| 25 | I | 8 | Good |
| 26 | J | 9 | Good |
| 27 | H | 9 | Good |
| 28 | I | 7 | Good |
| 29 | J | 8 | Good |

COMPARATIVE EXAMPLE 5

| Test No. | Photosensitive member sample | Packaging medium sample | Image evaluation results |
|---|---|---|---|
| 30 | H | Made of nylon | Blank areas appeared |
| 31 | L | Made of nylon | Blank areas appeared |

EXAMPLE 6

Example 1 was repeated to prepare photosensitive drums, except that polystyrene (number average molecular weight: 65,000) and a styrene/methyl methacrylate copolymer (weigh ratio: 8/2; number average molecular weight: 84,000) were respectively used in place of the two kinds of polycarbonates used in Example 1. These are respectively designated as photosensitive member samples K, L and M.

As packaging mediums, the packaging medium samples 4, 5 and 6 prepared in Example 1 were used and the same evaluation on image production as Example 1 was made. Results obtained are shown later.

COMPARATIVE EXAMPLE 6

Using the photosensitive member samples K and L prepared in Example 6, and packaging mediums made of polystyrene or polyethylene, the same evaluation on image production as Example 6 was made. Results obtained are shown below.

EXAMPLE 6

| Test No. | Photosensitive member sample | Packaging medium sample | Image evaluation results |
|---|---|---|---|
| 32 | K | 4 | Good |
| 33 | L | 5 | Good |
| 34 | M | 6 | Good |
| 35 | K | 5 | Good |
| 36 | L | 6 | Good |
| 37 | M | 4 | Good |

COMPARATIVE EXAMPLE 6

| Test No. | Photosensitive member sample | Packaging medium sample | Image evaluation results |
|---|---|---|---|
| 38 | K | Made of | Blank areas |

-continued

| Test No. | Photosensitive member sample | Packaging medium sample | Image evaluation results |
|---|---|---|---|
| 39 | L | polystyrene Made of polyethylene | appeared Blank areas appeared |

EXAMPLE 7

Example 3 was repeated to prepare photosensitive drums, except that polystyrene (number average molecular weight: 65,000) and a styrene/methyl methacrylate copolymer (weigh ratio: 8/2; number average molecular weight: 84,000) were respectively used in place of the polycarbonate used in Example 3. These are respectively designated as photosensitive member samples N and O.

As packaging mediums, the packaging medium samples 7, 8 and 9 used in Example 5 were used, and the same evaluation on image production as Example 3 was made. Results obtained are shown later.

COMPARATIVE EXAMPLE 7

Using the photosensitive member samples N and O prepared in Example 7, and packaging mediums made of nylon or polycarbonate, the same evaluation on image production as Example 7 was made. Results obtained are shown below.

EXAMPLE 7

| Test No. | Photosensitive member sample | Packaging medium sample | Image evaluation results |
|---|---|---|---|
| 40 | N | 7 | Good |
| 41 | O | 8 | Good |
| 42 | N | 9 | Good |
| 43 | O | 7 | Good |

COMPARATIVE EXAMPLE 7

| Test No. | Photosensitive member sample | Packaging medium sample | Image evaluation results |
|---|---|---|---|
| 44 | N | Made of nylon | Blank areas appeared |
| 45 | O | Made of polycarbonate | Blank areas appeared |

EXAMPLE 8

To prepare a packaging medium, 60 parts of polystyrene (average molecular weight: 20,000) as a binder resin, 20 parts of carbon powder (average particle diameter: 0.05 μm) as a colorant and 20 parts of conductive powder $InO_2$ (average particle diameter: 0.5 μm) were formed into a film in the same manner as Example 1.

The resulting film had a volume resistivity of $10^{10}$ Ω.cm, and showed a light-screening property with a screening rate of 99% or more.

This is designated as a packaging medium sample 10.

To prepare another packaging medium, the materials were formed into a film in entirely the same manner as the above, except that the conductive powder was replaced with $SbO_2$.

The resulting film had a volume resistivity of $10^{10}$ Ω.cm, and showed a light-screening property with a screening rate of 99%.

This is designated as a packaging medium sample 11.

Using these packaging mediums and the photosensitive member samples A and B prepared in Example 1, the same evaluation on image production as Example 7 was made. Results obtained are shown later.

COMPARATIVE EXAMPLE 8

Using the photosensitive member samples A and B prepared in Example 1, and packaging mediums made of polystyrene or polypropylene, the same evaluation on image production as Example 1 was made. Results obtained are shown below.

EXAMPLE 8

| Test No. | Photosensitive member sample | Packaging medium sample | Image evaluation results |
|---|---|---|---|
| 46 | A | 10 | Good |
| 47 | B | 11 | Good |
| 48 | A | 11 | Good |
| 49 | B | 10 | Good |

COMPARATIVE EXAMPLE 8

| Test No. | Photosensitive member sample | Packaging medium sample | Image evaluation results |
|---|---|---|---|
| 50 | A | Made of polystyrene | Blank areas appeared |
| 51 | B | Made of polypropylene | Blank areas appeared |

EXAMPLE 9

To prepare a packaging medium, 50 parts of polyethylene (average molecular weight: 200,000) as a binder resin, 20 parts of carbon powder (average particle diameter: 0.05 μm) as a colorant and 25 parts of conductive carbon powder were formed into a film in the same manner as Example 1.

The resulting film had a volume resistivity of $10^5$ Ω. cm, and showed a light-screening property with a screening rate of 99% or more.

This is designated as a packaging medium sample 12.

Using this packaging medium and the photosensitive member samples A and B prepared in Example 1, the same evaluation on image production as Example 1 was made. Results obtained are shown later.

COMPARATIVE EXAMPLE 9

Using the photosensitive member samples A and B prepared in Example 1, and packaging mediums made of polystyrene or polypropylene, the same evaluation on image production as Example 1 was made. Results obtained are shown below.

EXAMPLE 9

| Test No. | Photosensitive member sample | Packaging medium sample | Image evaluation results |
|---|---|---|---|
| 51 | A | 12 | Good |
| 52 | B | 12 | Good |

COMPARATIVE EXAMPLE 9

| Test No. | Photosensitive member sample | Packaging medium sample | Image evaluation results |
|---|---|---|---|
| 53 | A | Made of polystyrene | Blank areas appeared |
| 54 | B | Made of polypropylene | Blank areas appeared |

EXAMPLE 10

A packaging medium was prepared in the following manner.

Into a Banbury mixer, 50 parts of polystyrene (average molecular weight: 20,000) as a binder resin, 20 parts of carbon powder (average particle diameter: 0.05 μm) as a colorant and 30 parts of conductive powder, $SnO_2$ powder (average particle diameter: 0.5 μm) were put, and these were mixed with heating at 180° C. Thereafter, the mixture was formed into a film of 360 mm in length, 360 mm in width and 100 μm in film thickness by a calendering film formation process, to prepare a packaging medium.

This film had a volume resistivity of $10^4$ Ω. cm, and showed a light-screening property with a screening rate of 99%. This is designated as a packaging medium sample 13.

Next, another film was formed by using 60 parts of the same polystyrene as the above and 40 parts of the same conductive carbon powder as the above, which were mixed with heating at 180° C. using a Banbury mixer, following by the same procedures as the packaging medium sample 1.

The resulging film had a volume resistivity of $10^5$ Ω. cm, and light-screening property with a screening rate of 99%. This is designated as a packaging medium sample 14.

Also dispersed were 6 parts of the same polystyrene as the above, 20 parts of the like conductive carbon powder and 100 parts of cyclohexane, for 5 hours using a sand mill in which glass beads of 1 mm ϕ were used. The resulting dispersion was applied on a polyethylene plate with a thickness of 100 μm bar coating to carry out film formation, followed by drying at 100° C. for 30 minutes to form a film with a thickness of 10 μm.

The resulting film had a volume resistivity of $10^4$ Ω. cm and showed a light-screening property with a light-screening rate of 90% . This is designated as a packaging medium sample 15.

These packaging mediums were wrapped around the photosensitive members prepared in Example 1.

In the case when the packaging medium is in the form of a plate, the sheet-like photosensitive member was inserting between plates.

Thereafter the packing mediums were peeled, or taken off, from the photosensitive members, and the resulting photosensitive members were each set in a copying machine having electrophotographic processes comprising −5.5 kV corona charging, imagewise exposing to light, dry-toner developing, transferring to plain paper, and cleaning, to make evaluation on image production. Results obtained are shown later.

COMPARATIVE EXAMPLE 10

Packaging mediums made of polystyrene or polyethylene were respectively wrapped around, or put around, the photosensitive member samples A and C prepared in Example 1, and thereafter the packaging medium were peeled, or taken off, to make evaluation on image production by use of the same electrophotographic copying machine as Example 10. Results obtained are shown below.

EXAMPLE 10

| Test No. | Photosensitive member sample | Packaging medium sample | Image evaluation results |
|---|---|---|---|
| 55 | A | 13 | Good |
| 56 | A | 14 | Good |
| 57 | B | 13 | Good |
| 58 | B | 14 | Good |
| 59 | C | 15 | Good |

COMPARATIVE EXAMPLE 10

| Test No. | Photosensitive member sample | Packaging medium sample | Image evaluation results |
|---|---|---|---|
| 60 | A | Polystyrene sheet | Blank areas appeared |
| 61 | C | Polyethylene plate | Blank areas appeared |

We claim:

1. A packaging medium for packaging an organic photoconductor type electrophotographic photosensitive member subject to accumulation of electrostatic charges on the surface thereof when in contact with a packaging medium which comprises a single-layer packaging medium contacting a conductive material present in a matrix form, said conductive material being a conductive carbon, and said packaging medium having a volume resistivity of not more than $10^{12}$ Ω. cm, and a light-screening value of at least 90 percent, whereby said accumulation of electrostatic charges on said packaged organic photoconductor type electrophotographic photosensitive member is inhibited.

2. A packaging medium for an electrophotographic photosensitive member according to claim 1, wherein said packaging medium has a volume resistivity of not more than $10^5$ Ω. cm.

3. A packaging medium for an electrophotographic photosensitive member according to claim 1, wherein said packaging medium comprises said conductive carbon material and a resin matrix.

4. A packaging medium for an electrophotographic photosensitive member according to claim 3, wherein said resin is selected from the group consisting of polystyrene, nylon resin, polyester and polyethylene 5. A packaging medium for an electrophotographic photosensitive member according to claim 1, wherein said conductive carbon material is contained in an amount of from 5 to 70 wt. %.

6. A packaging medium for an electrophotographic photosensitive member according to claim 1, wherein said light-screening function is principally imparted by a colorant.

7. A packaging medium for an electrophotographic photosensitive member according to claim 1, wherein said packaging medium is in the form of a film.

8. A packaging medium for an electrophotographic photosensitive member according to claim 1, wherein said packaging medium is in the form of a bag.

9. An electrophotographic photosensitive member which is packaged with a packaging medium for an electrophotographic photosensitive member according to claim 1.

10. A packaging unit comprising:

(a) a single-layer packaging medium, said packaging medium containing a conductive carbon material present in a matrix form and having a volume resistivity of not more than $10^{12}$ Ω.cm and a light screening value of at least 90%; and (b) an organic photoconductor type electrophotographic photosensitive member within said packaging medium and subject to accumulation of electrostatic charges on the surface, said electrophotographic photosensitive member comprising a conductive substrate and a photosensitive layer provided on said conductive substrate, wherein said packaging medium inhibits the accumulation of electrostatic charges on said packaged organic photoconductor type electrophotographic photosensitive member.

11. A packaging medium for an electrophotographic photosensitive member according to claim 10, wherein said photosensitive layer has a laminated structure comprising a charge generation layer and a charge transport layer.

12. A packaging medium for an electrophotographic photosensitive member according to claim 10, wherein said photosensitive layer comprises a binder resin, and said binder resin is selected from the group consisting of a polycarbonate resin, polystyrene resin, a polymethyl methacrylate resin, a polyester resin and a polyarylate resin.

* * * * *

UNITED STATES PATENT AND TRADEMARK OFFICE

CERTIFICATE OF CORRECTION

PATENT NO. : 5,096,755

DATED : March 17, 1992

INVENTOR(S) : MASARU NAKAGAWA, ET AL.

It is certified that error appears in the above-identified patent and that said Letters Patent is hereby corrected as shown below:

COLUMN 1

Line 35, "operator" should read --operators--.
Line 37, "gaining" should read --showed--.
Line 60, "uneveness" should read --unevenness--.

COLUMN 2

Line 1, "along" should read --in connection with--.
Line 16, "diagramatically" should read --diagrammatically--.
Line 19, "diagramatically" should read --diagrammatically--.
Line 54, "uneveness" should read --unevenness--.

COLUMN 3

Line 26, "resin, to" should read --resin, is found to--.

COLUMN 4

Line 29, "compound," should read --compounds,--.

COLUMN 14

Line 35, "resulging" should read --resulting--.
Line 36, "and light-screening" should read --and showed a light-screening--.

COLUMN 15

Line 2, "medium" should read --mediums--.
Line 33, "contacting" should read --containing--.

UNITED STATES PATENT AND TRADEMARK OFFICE

CERTIFICATE OF CORRECTION

PATENT NO. : 5,096,755

DATED : March 17, 1992

INVENTOR(S) : MASARU NAKAGAWA, ET AL.

It is certified that error appears in the above-identified patent and that said Letters Patent is hereby corrected as shown below:

COLUMN 16

Line 25, "light" should read --light- --.

Signed and Sealed this

Third Day of August, 1993

Michael K. Kirk

Attest:

MICHAEL K. KIRK

Attesting Officer

Acting Commissioner of Patents and Trademarks